US006901234B2

(12) United States Patent
Ogiyama et al.

(10) Patent No.: US 6,901,234 B2
(45) Date of Patent: May 31, 2005

(54) IMAGE FORMING APPARATUS INCLUDING AN INTERMEDIATE IMAGE TRANSFER BELT AND HIGH RESISTANCE CONTACT MEMBER

(75) Inventors: Hiromi Ogiyama, Tokyo (JP); Katsuya Kawagoe, Tokyo (JP); Shin Kayahara, Yokohama (JP); Ryuuichi Minbu, Kawasaki (JP); Yuuji Sawai, Yokohama (JP); Mitsuru Takahashi, Kawasaki (JP); Satoru Uchida, Tokyo (JP); Hideki Kamiyama, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/389,979

(22) Filed: Mar. 18, 2003

(65) Prior Publication Data

US 2003/0219287 A1 Nov. 27, 2003

(30) Foreign Application Priority Data

Mar. 18, 2002 (JP) ..... 2002-074034
Mar. 18, 2002 (JP) ..... 2002-074294

(51) Int. Cl.[7] ..... G03G 15/16
(52) U.S. Cl. ..... 399/302
(58) Field of Search ..... 399/302, 308

(56) References Cited

U.S. PATENT DOCUMENTS 5,870,650 A 2/1999 Takahashi et al.
5,913,092 A 6/1999 Bisaiji et al.
5,983,060 A 11/1999 Namekata et al.
6,006,062 A 12/1999 Takahashi et al.
6,035,157 A 3/2000 Takahashi et al.
6,061,543 A 5/2000 Kayahara et al.
6,167,230 A 12/2000 Kimura et al.
6,175,702 B1 * 1/2001 Takeuchi et al. ..... 399/302
6,212,351 B1 4/2001 Kawagoe et al.
6,223,008 B1 4/2001 Takahashi et al.
6,269,228 B1 7/2001 Kayahara et al.
6,298,212 B1 * 10/2001 Kono et al. ..... 399/302
6,314,264 B1 * 11/2001 Iida et al. ..... 399/302
6,405,002 B2 6/2002 Ogiyama et al.
6,445,900 B2 9/2002 Fukao et al.
6,505,024 B2 1/2003 Kayahara et al.
6,516,179 B1 2/2003 Sawai et al.

FOREIGN PATENT DOCUMENTS

JP 6-102737 4/1994
JP 10-39642 2/1998
JP 2000-19854 1/2000
JP 2001-166614 6/2001
JP 2002-251076 9/2002

* cited by examiner

*Primary Examiner*—William J. Royer
(74) *Attorney, Agent, or Firm*—Oblon, Spivak, McClelland, Maier & Neustadt, P.C.

(57) ABSTRACT

An image forming apparatus of the present invention includes an intermediate image transfer belt passed over a plurality of support members and movable while carrying a toner image of preselected polarity transferred thereto. An electrode member contacts the inside surface of the belt and is applied with a preselected voltage for transferring the toner image from the belt to a recording medium. A contact member with high electric resistance contacts the belt at a position adjacent the electrode member and includes an insulating layer thereon.

19 Claims, 6 Drawing Sheets

IMAGE FORMING APPARATUS INCLUDING AN INTERMEDIATE IMAGE TRANSFER BELT AND HIGH RESISTANCE CONTACT MEMBER

BACKGROUND OF THE INVENTION

1. Field of the Invention

The present invention relates to a copier, printer, facsimile apparatus or similar image forming apparatus and more particularly to an image forming apparatus of the type including an intermediate image transfer belt.

2. Description of the Background Art

A color image forming apparatus including an intermediate image transfer body implemented as a belt or a drum belongs to a family of conventional image forming apparatuses. In the color image forming apparatus, toner images of different colors are sequentially formed on an image carrier while being sequentially transferred to the intermediate image transfer body one above the other. This image transfer will be referred to as primary image transfer. The resulting composite toner image is transferred from the intermediate image transfer belt to a sheet or recording medium. This image transfer will be referred to as secondary image transfer and is effected by a secondary image transfer roller or body and a back electrode or roller facing it. The back electrode is electrically connected to the inside surface of the intermediate image transfer body.

Some other electrodes usually adjoin the back electrode for secondary image transfer and are also electrically connected to the inside surface of the intermediate image transfer body. Such other rollers include a back electrode facing a cleaning member assigned to the intermediate image transfer body. An electric field is formed between the cleaning member and the back roller, which face each other, so that the cleaning member can collect toner left on the intermediate image transfer body after secondary image transfer.

Another electrode contacting the intermediate image transfer body is a back electrode facing a charging member configured to invert the polarity of the toner left on the intermediate image transfer body after secondary image transfer. An electric field is also formed between the charging member and the back electrode, which face each other, in order to invert the polarity of the above residual toner and then cause the toner to again deposit on an image carrier at a primary image transfer position.

Still another electrode contacting the intermediate image transfer body is a tension roller supported by the frame of the apparatus for applying tension to the image transfer body.

In this connection, Japanese Patent Laid-Open Publication No. 10-49019 discloses an image forming apparatus in which a voltage of the same polarity as toner is applied to the inside surface of an intermediate image transfer drum. By this voltage, toner left on the intermediate image transfer drum after secondary image transfer is inverted in polarity and then caused to again deposit on an image carrier at a primary image transfer station.

In the image forming apparatus of the type including the intermediate image transfer body, a voltage subject to constant-current control is applied from the back electrode for secondary image transfer to the inside surface of the above image transfer body. At the same time, the secondary image transfer roller is grounded. As a result, an electric field for secondary image transfer is formed between the intermediate image transfer body and the secondary image transfer roller. This electric field varies little even when some current flows via a recording medium or even when the resistance of the intermediate image transfer body or that of the secondary image transfer roller varies, allowing a stable image to be formed on the recording medium.

However, when any one of the electrodes adjoining the back roller for secondary image transfer roller, as stated earlier, is grounded, a current fed to the back roller for secondary image transfer leaks to the other back roller via the intermediate image transfer body. As a result, a current flowing toward the recording medium becomes short. Further, when the tension roller contacting the inside surface of the intermediate image transfer body adjoins the back roller for secondary image transfer, the current fed from the back roller for secondary image transfer to the intermediate image transfer body leaks to the frame of the apparatus via the above image transfer body, again making the current flowing toward the recording medium short.

Technologies relating to the present invention are also disclosed in, e.g., Japanese Patent Laid-Open Publication Nos. 6-102737, 10-39642, 2000-19854, 2001-166614 and 2002-251076

SUMMARY OF THE INVENTION

It is an object of the present invention to provide an image forming apparatus capable of preventing a current expected to form an electric field for secondary image transfer from leaking to an electrode or a member adjacent a back roller for secondary image transfer to thereby insure a stable image at all times.

An image forming apparatus of the present invention includes an intermediate image transfer belt passed over a plurality of support members and movable while carrying a toner image of preselected polarity transferred thereto. An electrode member contacts the inside surface of the belt and is applied with a preselected voltage for transferring the toner image from the belt to a recording medium. A contact member with high electric resistance contacts the belt at a position adjacent the electrode member.

BRIEF DESCRIPTION OF THE DRAWINGS

The above and other objects, features and advantages of the present invention will become more apparent from the following detailed description taken with the accompanying drawing in which.

DESCRIPTION OF THE PREFERRED EMBODIMENTS

Figure 1:
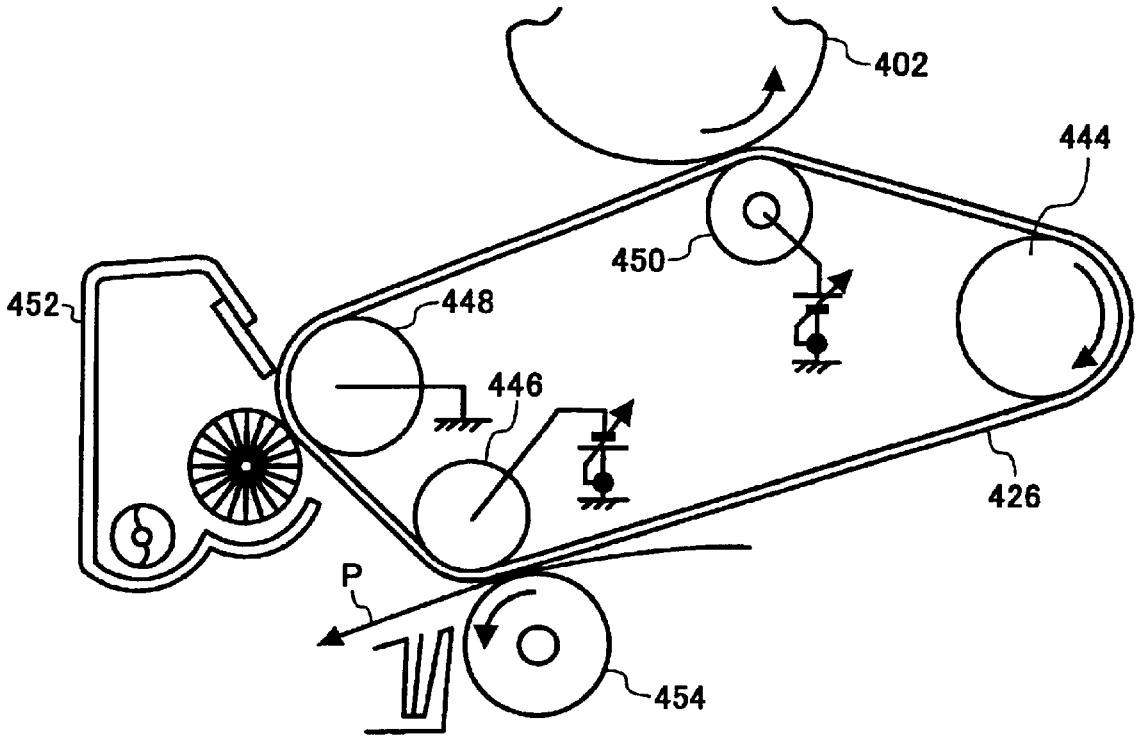
FIG. 1 PRIOR ART
FIG. 1 is a fragmentary view showing a conventional image forming apparatus including an intermediate image transfer belt.

To better understand the present invention, brief reference will be made to a conventional image forming apparatus, shown in FIG. 1. As shown, the image forming apparatus includes an intermediate image transfer belt (simply belt hereinafter) 426 passed over an electrode roller 450 for primary image transfer, a drive roller 444, a back roller or back electrode 446, and a back roller or back electrode 448. The back roller 450 faces a photoconductive drum or image carrier 402 while the back roller 446 faces a secondary image transfer roller 454. The back roller 448 faces a cleaning unit 452 configured to clean the surface of the belt 426.

A bias for primary image transfer is applied to the electrode roller 450 for transferring a toner image formed on the drum 402 to the belt 426. Such image transfer is repeated color by color with the result that a composite color image is formed on the belt 426. A bias for secondary image transfer, which is of the same polarity as toner, is applied to the back roller 446, for thereby transferring the color image from the belt 426 to a sheet or recording medium P.

More specifically, the bias applied to the back roller 446 forms an electric field for secondary image transfer between the belt 426 and the sheet P. Even when the resistance of the sheet P or that of the belt 426 or the secondary image transfer roller 454 varies, the above electric field varies little and allows a stable image to be formed on the sheet P.

The back roller for cleaning 448 is generally formed of stainless steel or similar conductive metal and electrically connected to the frame of the apparatus.

The conventional apparatus described above operates in a satisfactory manner so long as the resistance of the belt 426 is sufficiently high. However, assume that the resistance of the belt 426, particularly its inner surface contacting the back roller 446, is lowered to about $10^{10}$ Ω·cm in terms of surface resistivity due to resistance shift ascribable to the varying environment or the deterioration of current feed. Then, a current fed to the back roller 446 leaks to the back roller 448, which adjoins the back roller 446, via the belt 426. As a result, a current flowing toward the sheet P and therefore the electric field for secondary image transfer becomes short, lowering image quality.

Preferred embodiments of the image forming apparatus in accordance with the present invention will be described hereinafter.

First Embodiment

Figure 2:
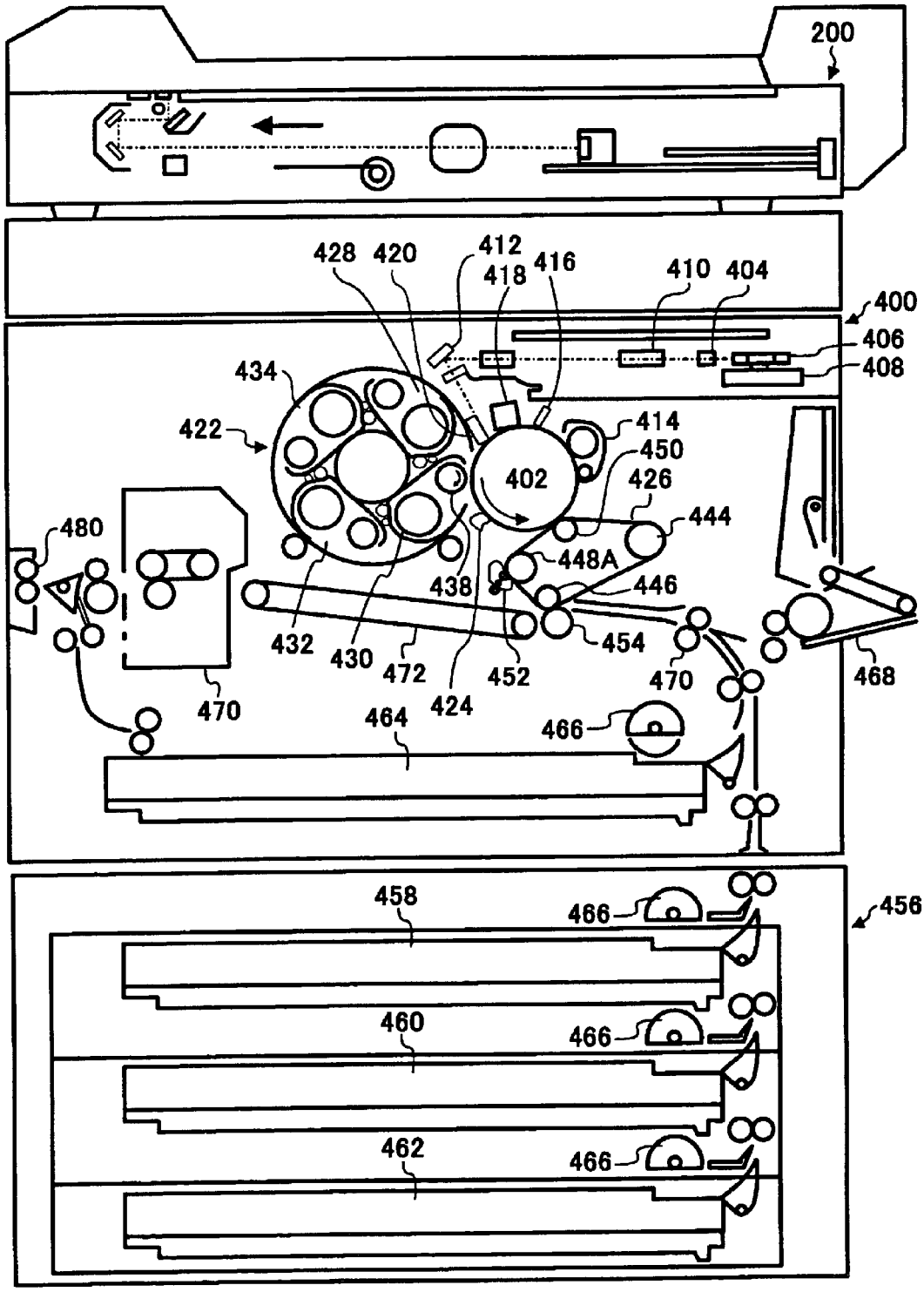
FIG. 2 is a view showing an image forming apparatus applicable to a first to a third embodiment of the present invention.
Figure 3:
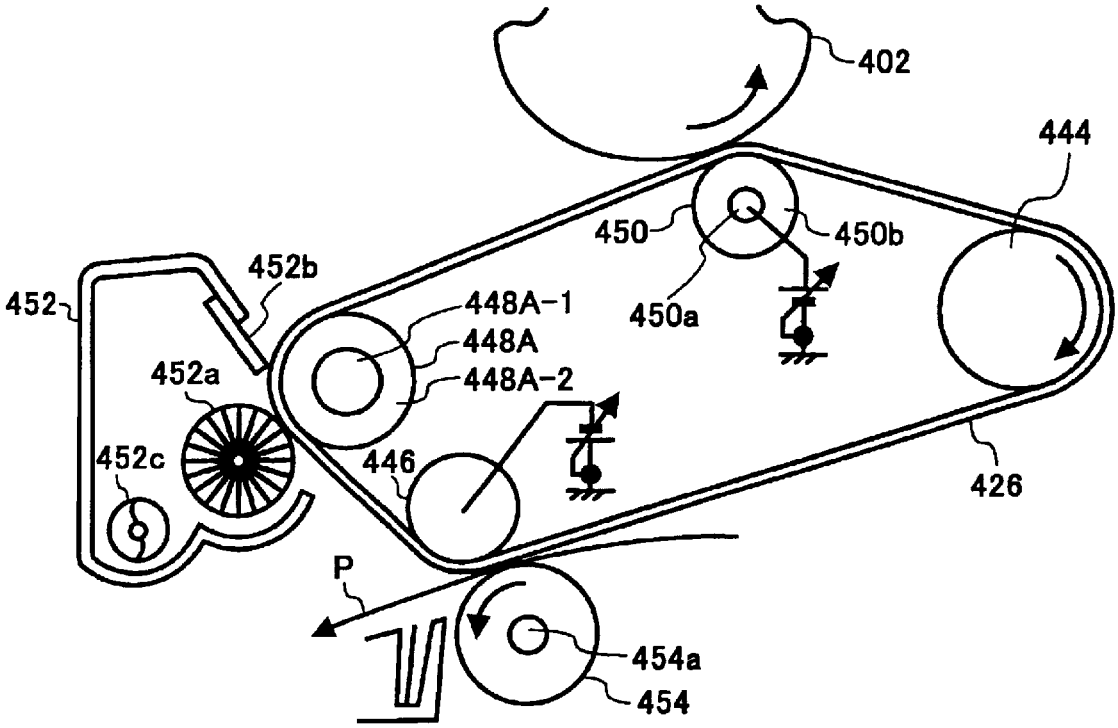
FIG. 3 is a fragmentary view showing an intermediate image transfer body and members associated therewith and representative of the first embodiment of the present invention.

Referring to FIGS. 2 and 3, an image forming apparatus embodying the present invention is shown and implemented as a color copier by way of example. In FIGS. 2 and 3, structural elements identical with the structural elements shown in FIG. 1 are designated by identical reference numerals.

As shown in FIG. 2, the color copier includes an optical writing unit 400. The writing unit 400 converts color image data received from a color scanner 200 to a corresponding optical signal and scans a photoconductive drum or image carrier 402 with the optical signal for thereby forming a latent image on the drum 402. The writing unit 400 includes a laser diode 404, a polygonal mirror 406, a motor 408 assigned to the polygonal mirror 406, an f/θ lens 410, and a mirror 412.

The drum 402 is rotatable counterclockwise, as indicated by an arrow in FIG. 2. Arranged around the drum 402 are a drum cleaning unit 414, a quenching lamp 416, a potential sensor 420, a revolver type developing unit (revolver hereinafter) 422, a density pattern sensor 424, and an intermediate image transfer belt or body (simply belt hereinafter) 426. The revolver 422 is positioned such that one of a plurality of developing sections thereof is located at a developing position where it faces the drum 402; a developing section 438 is shown as facing the drum 402 in FIG. 2.

More specifically, the revolver 422 includes a black, a cyan, a magenta and a yellow developing section 428, 430, 432 and 434 and a drive section, not shown, for causing such drive sections to revolve. The developing sections 428 through 434 are identical in configuration except for the color of toner.

In a stand-by condition, the revolver 422 is positioned such that the black developing section 428 faces the drum 402. On the start of a copying cycle, the color scanner 200 starts reading black image data from a document at preselected timing. The writing unit 400 starts forming a latent image (black latent image hereinafter) on the drum 402 with a laser beam modulated in accordance with the image data.

Before the leading edge of the black latent image arrives at the developing position, a sleeve included in the black developing section 428 starts being rotated to develop the black latent image from the leading edge to the trailing edge. As a result, a toner image of negative polarity is formed on the drum 402. As soon as the trailing edge of the black latent image moves away from the developing position, the revolver 422 is caused to rotate to bring the next image forming section to the developing position. This rotation completes at least before the leading edge of a latent image derived from the next color image data arrives at the developing position.

On the other hand, when the copying cycle begins, a motor, not shown, causes the drum 402 to rotate counterclockwise while another motor, not shown, causes the belt 5426 to turn clockwise, as viewed in FIG. 2. While the belt 426 is in movement, a black (Bk), a cyan (C), a magenta (M) and a yellow (Y) toner image are sequentially formed on the drum 402 while being sequentially transferred to the belt 426 one above the other, completing a full-color image. This is the primary image transfer mentioned earlier.

The belt 426 is passed over an electrode roller 450 for primary image transfer, a drive roller 444, a back roller or electrode roller for secondary image transfer 446, and a back roller 448A. The electrode roller 450 faces the drum 402 while the back roller 446 faces a secondary image transfer roller or body 454. The back roller 448A faces a cleaning unit 452 configured to clean the surface of the belt 425. The back roller for secondary image transfer 446 transfers the full-color image from the belt 426 to a sheet or recording medium.

A sheet bank 456 includes sheet cassettes 458, 460 and 462 loaded with stacks of sheets different in size from sheets stacked on a sheet cassette 464 disposed in the apparatus body. A particular pickup roller 466 is associated with each of the sheet cassettes 458 through 464 and pays out the sheets from the associated sheet cassette toward a registration roller pair 470 one by one. A manual feed tray 468 is also mounted on the apparatus body for allowing OHP (OverHead Projector) films, thick sheets or similar special sheets-to be fed by hand.

When image formation begins, a sheet is fed from designated one of the sheet cassettes 458 through 464 to the registration roller pair 470 and stopped for a moment thereby. The registration roller pair 470 starts conveying the sheet at such timing that the leading edge of the sheet meets the leading edge of the toner image being conveyed by the belt 426 at the back roller 446.

A bias for secondary image transfer, which is of the same polarity as toner, is applied to the back roller for secondary image transfer 446. When the sheet laid on the belt 426 is conveyed below the back roller 446, the toner image is transferred from the belt 426 to the sheet. This is the secondary image transfer. Subsequently, the sheet with the toner image is quenched, separated from the belt 426, and then handed over to a belt conveyor 472. The belt conveyor 472 conveys the sheet to a fixing unit 470 of the type using a belt. The fixing unit 470 fixes the toner image on the sheet with heat and pressure. The sheet coming out of the fixing unit 470 is driven out to a tray, not shown, as a full-color copy.

Reference will be made to FIG. 3 for describing an intermediate image transfer mechanism unique to the illustrative embodiment. In the illustrative embodiment, the belt 426 is made up of a base layer, an intermediate layer and a surface layer sequentially laminated in this order. The base layer, which is 50 $\mu$m to 100 $\mu$m thick, is formed of polyimide resin with carbon dispersed therein. This composition frees an image from expansion and contraction. The intermediate layer, which is 100 $\mu$m to 300 $\mu$m thick, is formed of urethane, chloroprene or similar elastic rubber whose resistance is adjusted by carbon or titanium oxide. The surface layer, which is 1 $\mu$m to 20 $\mu$m thick, is formed of fluorocarbon resin, PVDF or similar material having parting ability. The belt 426 has surface resistivity of $10^{10}$ $\Omega$·cm to $10^{12}$ $\Omega$·cm on the inner surface, volume resistivity of $10^{10}$ $\Omega$·cm to $10^{13}$ $\Omega$·cm, and surface resistivity of $10^{10}$ $\Omega$·cm to $10^{14}$ $\Omega$·cm on the outer surface.

The electrode roller 450, facing the drum 402, is made up of a metallic core 450*a* and an elastic layer 450*b* covering the core 450*a* and having low or medium resistance. A positive voltage controlled to a preselected current value is applied to the core 450*a*, so that the toner image of negative polarity is transferred from the drum 402 to the belt 426.

The secondary image transfer roller 454 is made up of a core 454*a*, an elastic intermediate layer, and a surface layer. The intermediate layer is formed of chloroprene or NBR rubber in which carbon or titanium oxide is dispersed for the adjustment of resistance. The surface layer, which is 1 $\mu$m to 20 $\mu$m thick, is formed of fluorocabon resin or PVDF having parting ability. The core 454*a* is electrically connected to the frame of the apparatus and not applied with a voltage.

The back roller 446, contacting the inner surface of the belt 426, is formed of stainless steel and provided with surface roughness of 2 $\mu$m or below. When the sheet P is nipped between the belt 426 and the secondary image transfer roller 454, a negative voltage controlled to a preselected current value is applied to the back roller 446. As a result, the toner image of negative polarity is transferred from the belt 426 to the sheet P.

The cleaning unit 452 includes a rotary brush 452*a*, a blade 452*b*, and a screw 452*c*. The brush 452*a* is rotated to coat zinc stearate or similar lubricant on the outer surface of the belt 426 or form an electric field for cleaning, thereby collecting the toner from the belt 426. The blade 452*b* scrapes off the toner left on the belt 426. The screw 452*c* conveys the toner thus collected by the brush 452*a* and blade 452*b*. Only one of the brush 452*a* and blade 452*b* may be used, if desired.

The back roller 448A associated with the cleaning unit 452 is made up of a metallic core 448A-1 and a high-resistance layer 448A-2 covering the core 448A-1. The high-resistance layer 448A-2 is 0.5 $\mu$m to 5 $\mu$m thick and provided with surface roughness of 2 $\mu$m or below. The high-resistance layer is formed of POM (polyacetal) resin in which barium titanate is dispersed as a conduction filler, and provided with volume resistivity of $11^{11}$ $\Omega$·cm to $10^{14}$ $\Omega$·cm. Particularly, when the blade 452*b* is used as a cleaning blade alone, the high-resistance layer 448A-2 is formed of non-elastic resin in order to preserve the expected cleaning ability even when the back roller 448A is displaced or deformed.

For the surface layer of the back roller 448A, use may be made of insulative resin not containing a conduction filler. Further, even when the back roller 448 has metallic conductivity, but is not grounded via the frame of the apparatus (floating state), it effectively obviates the leak of a current from the back roller 446. However, when charge accumulates in such a surface layer, the surface layer is likely to form a strong electric field and cause defects having a diameter of about 1 mm each to appear in an image. This is presumably because the charge is released to the brush 452*a* of the cleaning unit 452. In addition, noise ascribable to such discharge is apt to cause the apparatus to malfunction or to prevent it from meeting electromagnetic wave standards.

Second Embodiment

An alternative embodiment of the present invention will be described with reference to FIG. 4. The structural elements of this embodiment identical with those of the previous embodiment are designated by identical reference numerals and will not be described in detail. This is also true with other embodiments to follow.

Figure 4:
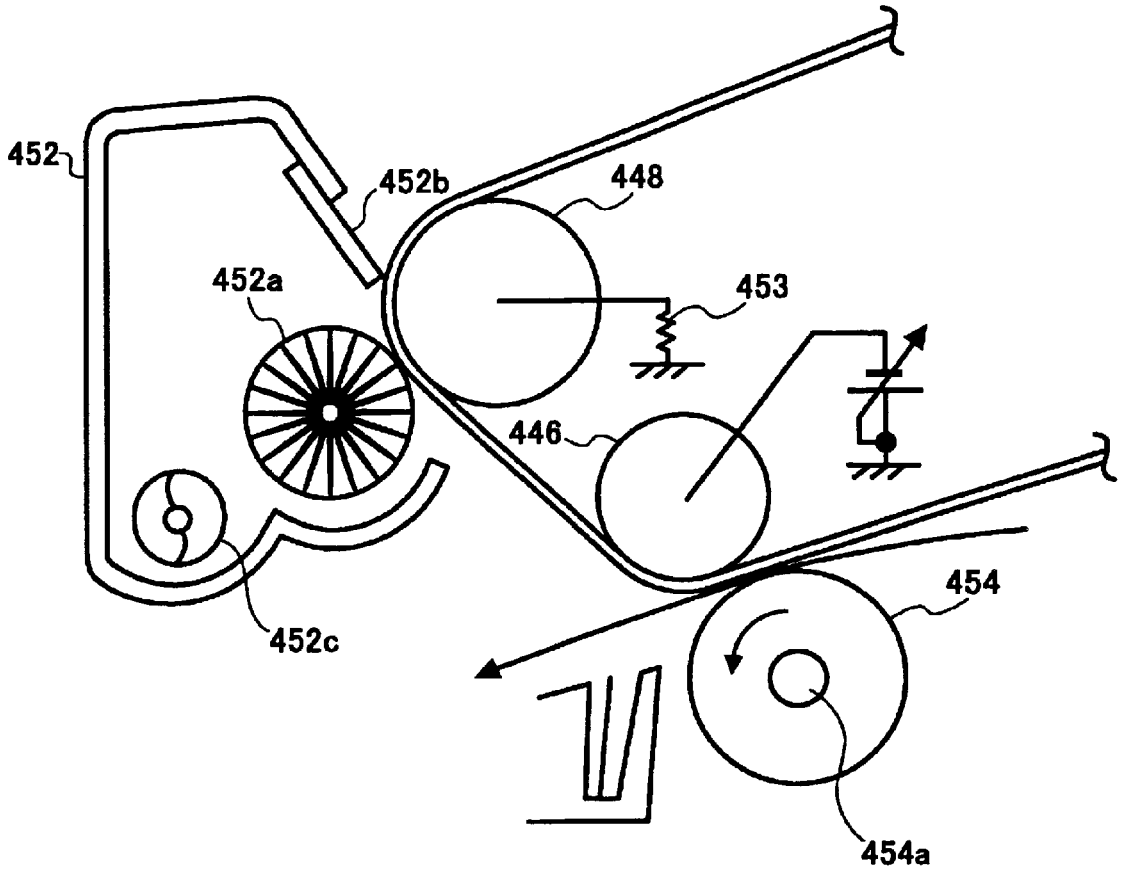
FIG. 4 is a fragmentary view showing the second embodiment of the present invention.

As shown in FIG. 4, a back roller for cleaning 448, like the conventional back roller 448, is implemented as a metal conductor or similar low-resistance member. In the illustrative embodiment, a resistor 453 is connected between the back roller 448 and the frame of the apparatus and should preferably have resistance of 30 M$\Omega$ to 3 G$\Omega$. This resistance reduces the leak current preventing effect if too low or raises the voltage of the back roller 448 to thereby bring about abnormal discharge stated earlier if too high. When the resistance is adequate, the voltage of the back roller 448 is about 1 kV to 4 kV in absolute value and directly acts on opposite ends of the resistor 453. The resistor 453 therefore must be highly voltage-resistant.

Further, the voltage of the back roller 448 mentioned above is closer to the voltage applied to the back roller 446, i.e., a difference in potential between the back rollers 446 and 448 is reduced. This also contributes to the reduction of leak current.

Third Embodiment

Figure 5:
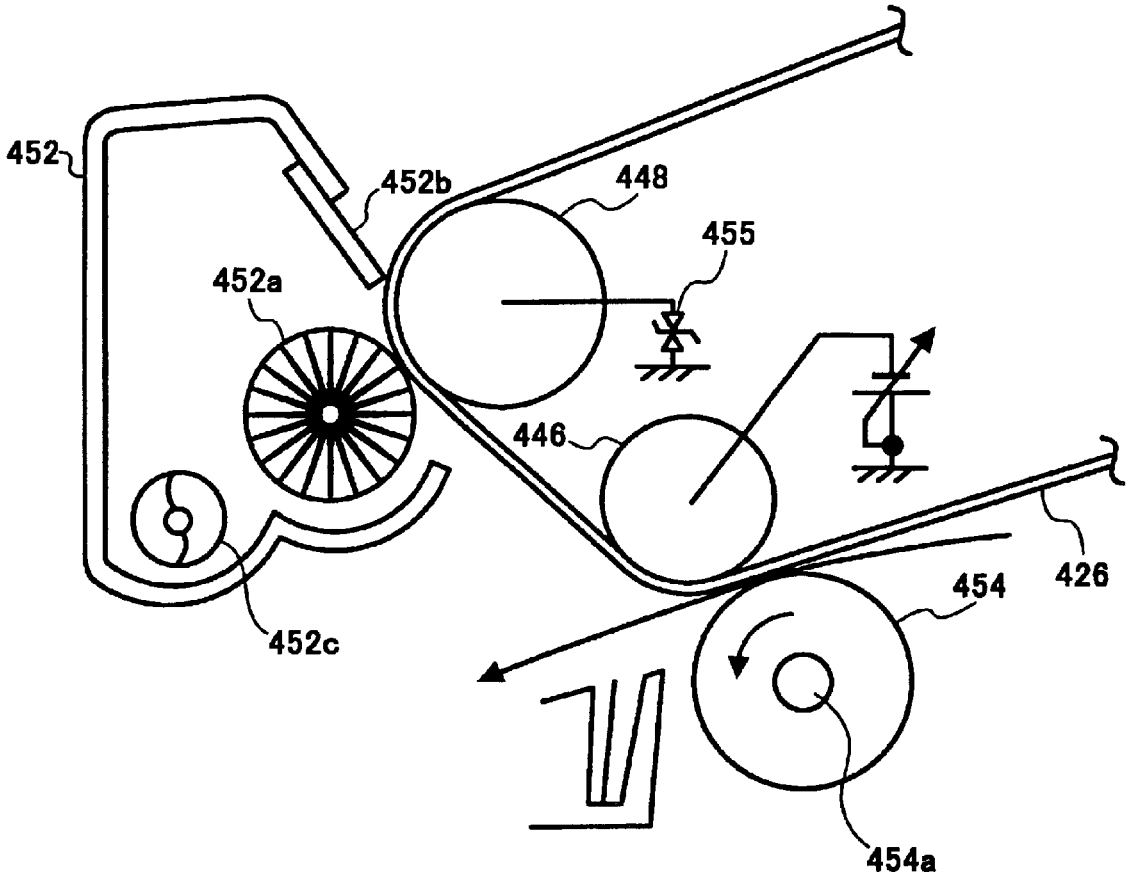
FIG. 5 is a view similar to FIG. 4, showing the third embodiment of the present invention.

Another alternative embodiment of the present invention will be described with reference to FIG. 5. As shown, the back roller 448 associated with the cleaning unit 452 is also implemented as a metal conductor or similar low-resistance member. In the illustrative embodiment a Zener diode or similar constant-voltage device 455 is connected between the back roller 448 and the frame of the apparatus. If the voltage of the constant-voltage device 455 is close to the voltage applied to the back roller 446, then it is possible to reduce the leak current.

The voltage of the constant-voltage device 455 should preferably be about 1 kV to 4 kV in absolute value or may be made higher than the voltage applied to the back roller 446 in order to practically obviate the leak current. Such a high voltage, however, is apt to bring about abnormal discharge stated earlier. In light of this, the above voltage should preferably be about 4 kV in absolute value or must be about 7 kV or below.

The advantages of the first to third embodiments described above are also achievable with an image forming apparatus of the type transferring toner images of different colors from a plurality of drums to an intermediate image transfer body one above the other, and then transferring the resulting color image to a recording medium.

As stated above, the first to third embodiments reduce a current to leak from the back roller for secondary image transfer to the cleaning back roller via the intermediate image transfer body, thereby insuring stable images.

Fourth Embodiment

Figure 6:
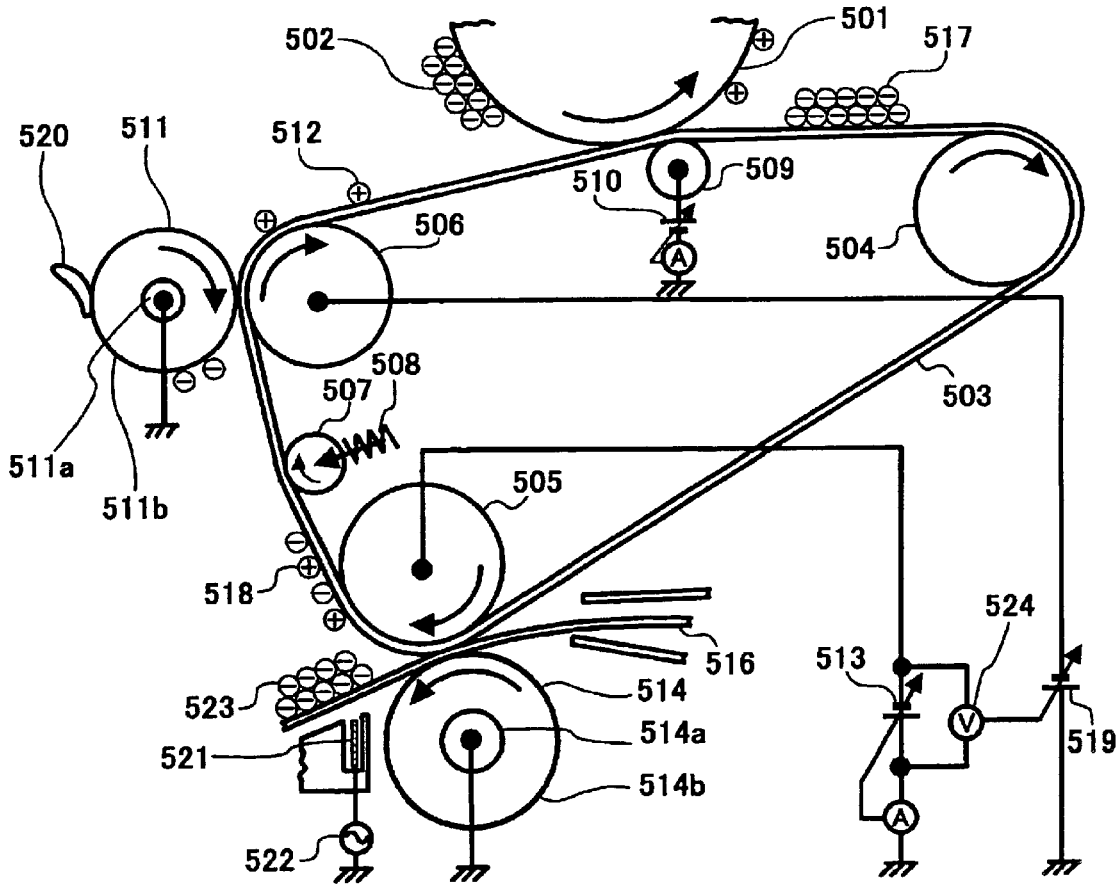
FIG. 6 is a fragmentary view showing a fourth embodiment of the present invention.

FIG. 6 shows still another alternative embodiment of the present invention, particularly the polarities of toner grains and power supply devices for applying voltages to various electrodes. It is to be noted that the amount of toner grains shown in FIG. 6 is not proportional to the actual amount, but is qualitatively representative of a difference in amount.

As shown in FIG. 6, conventional image forming means forms a toner image of negative polarity, or regular polarity, on a photoconductive drum or image carrier 501. More specifically, a charger, not shown, uniformly charges the surface of the drum 501 being rotated. An optical writing unit, not shown, scans the charged surface of the drum 501 in accordance with image data color by color. The resulting latent images are developed to produce, e.g., a Y, an M, a C or a Bk toner image 502.

An intermediate image transfer belt (simply belt hereinafter) 503 is passed over a drive roller 504, a back roller for secondary image transfer 505, a back roller for cleaning 506, and a tension roller 507. The belt 503 is held in contact with the drum 501 at a primary image transfer position. A drive source, not shown, causes the belt 503 to move at the same peripheral speed as the drum 501. A spring 508 constantly presses the tension roller 507 against the inner surface of the belt 503, thereby applying tension to the belt 503.

A back roller for primary image transfer 509 is made up of a metallic core and a low- or medium-resistance elastic layer covering the core, although not shown specifically, and electrically connected to the inner surface of the belt 503. A power supply device 510 applies a positive voltage controlled to a constant current value to the core of the back roller 509, thereby forming an electric field for primary image transfer between the above core and the conductive core of the drum 501. The toner images of negative polarity sequentially formed on the drum 501 are sequentially transferred to the belt 503 one above the other, completing a full-color image. After the primary image transfer, a cleaning unit, not shown, cleans the surface of the drum 501 to thereby prepare it for the next image forming cycle.

A cleaning roller or cleaning member 511 is assigned to the belt 503. A moving mechanism, not shown, maintains the cleaning roller 511 released from the belt 503 while the primary image transfer for forming the full-color image is under way. After the secondary transfer of the full-color image from the belt 503 to a sheet or recording medium 516, the moving mechanism moves the cleaning roller 511 into contact with the belt 503 so as to clean the belt 503. Toner grains of positive polarity 512, which the cleaning roller 511 has failed to remove from the belt 503, are again transferred to the drum 501 at the primary image transfer position.

The back roller for secondary image transfer 505 is formed only of metal and electrically connected to the inner surface of the belt 503. A power supply device 513 applies a negative voltage controlled to a constant current value to the back roller 505. A secondary image transfer roller or body 514 is made up of a metallic core 514*a* and a low- or medium-resistance elastic layer 514*b* covering the core 514*a* and electrically connected to the inner surface of the belt 503. The core 514*a* is connected to ground.

The sheet 516 is fed from a sheet feeding device, not shown, to a secondary image transfer position between the belt 503 and the secondary image transfer roller 514. A power supply device 513 applies a negative voltage controlled to a preselected current value to the inner surface of the belt 503 via the back roller 505, thereby forming an electric field for secondary image transfer. In this condition, a full-color toner image of negative polarity 517 is transferred from the belt 503 to the sheet 516. An AC power supply 522 applies an AC voltage to a discharge needle 521, so that the sheet 516 is discharged and thereby separated from the belt 503. Subsequently, the sheet 516 with the toner image is conveyed to a fixing unit, not shown, and has the toner image fixed thereby. The sheet is then driven out to a tray not shown.

The electric field for secondary image transfer causes positive charge to be induced from the core 514*a* of the secondary image transfer roller 514, so that charge is injected into the toner grains of the toner image during secondary image transfer. As a result, residual toner grains 518 left on the belt 503 after the secondary image transfer are partly of positive polarity and partly of negative polarity.

The back roller for cleaning 506 is formed only of metal. A power supply device 519 applies a negative voltage of the same size as the voltage applied to the back roller 505 to the back roller 506. More specifically, the power supply device 519 applies a negative voltage of the same size as the output voltage of the power supply device 513 in accordance with a signal output from a voltage sensor 524, which is responsive to the output voltage of the power supply device 513. Alternatively, the power supply device 513 may be branched to apply a single negative voltage to both of the back rollers 505 and 506.

The cleaning roller 511 is made up of a metallic core 511*a* and a low- or medium-resistance elastic body 511*b* covering the core 511*a*. The core 511*a* is connected to ground. The voltage applied from the power supply device 519 to the back roller 506 forms an electric field for cleaning between the back roller 506 and the core 511*a* of the cleaning roller 511. Consequently, among the residual toner grains 518 on the belt 503, the toner grains of negative polarity are transferred from the belt 503 to the cleaning roller 511. A cleaning blade 520 removes such toner grains from the cleaning roller 11.

The electric field for cleaning causes positive charge to be induced from the core 511*a* of the cleaning roller 511, which is connected to ground. The positive charge is injected into the toner grains during cleaning for thereby inverting their polarity. In this sense, the cleaning roller 511 plays the role of a charging member for inverting the polarity of the toner grains left on the belt 503 while the back roller 506 plays the role of a back electrode.

As stated above, the toner grains of negative polarity are transferred two times by the secondary image transfer and cleaning while being subjected to charge injection two times. Consequently, only the toner grains of positive polarity are left on the belt 503 after the cleaning step and again transferred to the drum 501 by the electric field for primary image transfer.

The tension roller 507, intervening between the back rollers 505 and 506, is a member contacting the belt 503 at a position closest to the back roller 505. In the illustrative embodiment, the tension roller 507 is made up of a metallic core and a polycarbonate or similar insulative resin layer covering the core. The insulative resin therefore electrically isolates the belt 505 from the frame of the apparatus. This prevents a current from leaking from the tension roller 507 via the belt 503 and effecting the secondary image transfer.

The drive roller 504 is remote from the back roller 505 and therefore causes a minimum of current to leak therefrom via the belt 503.

As stated above, in the illustrative embodiment, a voltage of the same polarity as a voltage applied to the back roller 505 for secondary image transfer 505 is applied to the back roller for cleaning 506 adjacent the roller 505. This reduces the leak of a current, which forms an electric field for secondary image transfer, to the electrode 506 via the belt 503. In this condition, a voltage subject to constant current control is applied from the electrode 505 to the inner surface of the belt 503, forming the electric field for secondary image transfer between the belt 503 and the secondary image transfer roller 514. Therefore, even if some current flows via the sheet 516 or even if the resistance of the belt 503 or that of the secondary image transfer roller 514 varies, the electric field for secondary image transfer varies little. This successfully prevents the current to the sheet 516 from becoming short and thereby allows a stable image to be formed on the sheet 516 without fail.

Because the voltage applied to the back roller for cleaning 506 is opposite in polarity to the toner, an electric field for transferring the residual toner from the belt 503 to the cleaning roller 511 can be surely formed even when the cleaning roller 511 is grounded. This, coupled with a small potential difference between the two electrodes 505 and 506, reduces the leak of a current fed from the electrode 505 to the electrode 506 via the belt 503. Further, even when the cleaning roller 511 is grounded, charge opposite in polarity to the toner is induced and injected into the toner for thereby inverting the polarity of the residual toner. The toner thus inverted in polarity again deposits on the drum 501.

In the illustrative embodiment, the portion where the belt 503 and tension roller 507 contact each other is electrically isolated from the frame of the apparatus. This obviates current leak from the tension roller 507 via the belt 503.

Moreover, the same voltage of the same polarity is applied to both of the back electrode 505 and back electrode adjacent thereto, so that the leak of the current, which forms the electric field for secondary image transfer, to the electrode 506 via the belt 503 is practically obviated. The electric field therefore varies little even if some current flows via the sheet 516 or even if the resistance of the belt 503 or that of the secondary image transfer roller 514 varies.

If desired, the cleaning member and back electrode for cleaning and the charging member and back electrode for charging may be configured independently of each other. The illustrative embodiment is also applicable to an image forming apparatus of the type transferring toner images of different colors from a plurality of photoconductive drums to an intermediate image transfer belt one above the other, and then transferring the resulting color image from the belt to a recording medium.

Various modifications will become possible for those skilled in the art after receiving the teachings of the present disclosure without departing from the scope thereof.

What is claimed is:

1. An image forming apparatus comprising:

a flexible intermediate image transfer body passed over a plurality of support members and movable while carrying a toner image of preselected polarity transferred thereto by primary image transfer;

an electrode member contacting an inner surface of said intermediate image transfer body and applied with a preselected voltage for transferring the toner image from said intermediate image transfer body to a recording medium by secondary image transfer; and a contact member having high electric resistance and contacting said intermediate image transfer body at a position adjacent said electrode member.

2. The apparatus as claimed in claim 1, wherein said contact member has a high-resistance layer on a surface thereof.

3. The apparatus as claimed in claim 2, further comprising cleaning means for cleaning an outer surface of said intermediate image transfer body, wherein said contact member faces said cleaning means with the intermediary of said intermediate image transfer body.

4. The apparatus as claimed in claim 1, further comprising cleaning means for cleaning an outer surface of said intermediate image transfer body, wherein said contact member faces said cleaning means with the intermediary of said intermediate image transfer body.

5. An image forming apparatus comprising:

a flexible intermediate image transfer body passed over a plurality of support members and movable while carrying a toner image of preselected polarity transferred thereto by primary image transfer;

an electrode member contacting an inner surface of said intermediate image transfer body and applied with a preselected voltage for transferring the toner image from said intermediate image transfer body to a recording medium by secondary image transfer; and a contact member having high electric resistance and contacting said intermediate image transfer body at a position adjacent said electrode member, wherein said contact member has an insulating layer on a surface thereof.

6. The apparatus as claimed in claim 5, further comprising cleaning means for cleaning an outer surface of said intermediate image transfer body, wherein said contact member faces said cleaning means with the intermediary of said intermediate image transfer body.

7. An image forming apparatus comprising:

a flexible intermediate image transfer body passed over a plurality of support members and movable while carrying a toner image of preselected polarity transferred thereto by primary image transfer;

an electrode member contacting an inner surface of said intermediate image transfer body and applied with a preselected voltage for transferring the toner image from said intermediate image transfer body to a recording medium by secondary image transfer;

a contact member having high electric resistance and contacting said intermediate image transfer body at a position adjacent said electrode member; and a resistor connected between said contact member and a frame of said apparatus.

8. The apparatus as claimed in claim 7, further comprising cleaning means for cleaning an outer surface of said intermediate image transfer body, wherein said contact member faces said cleaning means with the intermediary of said intermediate image transfer body.

9. An image forming apparatus comprising:

a flexible intermediate image transfer body passed over a plurality of support members and movable while carrying a toner image of preselected polarity transferred thereto by primary image transfer;

an electrode member contacting an inner surface of said intermediate image transfer body and applied with a preselected voltage for transferring the toner image from said intermediate image transfer body to a recording medium by secondary image transfer;

a contact member having high electric resistance and contacting said intermediate image transfer body at a position adjacent said electrode member; and a constant-voltage device connected between said contact member and a frame of said apparatus.

10. An image forming apparatus comprising:

an image carrier to which a toner image of preselected polarity is transferred;

an intermediate image transfer body to which the toner image is transferred from said image carrier by primary image transfer;

a first electrode member electrically connected to an inside surface of said intermediate image transfer body and configured to apply a voltage of same polarity as regular polarity of toner to said inside surface to thereby transfer the toner image from said intermediate image transfer body to a recording medium by secondary image transfer; and a second electrode member adjacent at least one of upstream and downstream of said first electrode member and electrically connected to said intermediate image transfer body and applied with a voltage of a same polarity as the voltage applied to said first electrode member.

11. The apparatus as claimed in claim 10, wherein the voltage applied to the inside surface of said intermediate image transfer body is subject to constant current control.

12. An image forming apparatus comprising:

an image carrier to which a toner image of preselected polarity is transferred;

an intermediate image transfer body to which the toner image is transferred from said image carrier by primary image transfer;

a first electrode member electrically connected to an inside surface of said intermediate image transfer body and configured to apply a voltage of same polarity as regular polarity of toner to said inside surface to thereby transfer the toner image from said intermediate image transfer body to a recording medium by secondary image transfer;

a cleaning member configured to remove toner left on said intermediate image transfer body after the secondary image transfer; and a second electrode member facing said cleaning member and electrically connected to the inside surface of said intermediate image transfer body and configured to apply a voltage to said inside surface for thereby transferring toner left on said intermediate image transfer body after the secondary image transfer to said cleaning member.

13. The apparatus as claimed in claim 12, wherein the voltage applied to the inside surface of said intermediate image transfer body is subject to constant current control.

14. The apparatus as claimed in claim 12, wherein the voltage applied to said second electrode member is identical in polarity and size as the voltage applied to said intermediate image transfer body.

15. An image forming apparatus comprising:

an image carrier to which a toner image of preselected polarity is transferred;

an intermediate image transfer body to which the toner image is transferred from said image carrier by primary image transfer;

a first electrode member electrically connected to an inside surface of said intermediate image transfer body and configured to apply a voltage of same polarity as regular polarity of toner to said inside surface to thereby transfer the toner image from said intermediate image transfer body to a recording medium by secondary image transfer; and a second electrode member electrically connected to the inside surface of said intermediate image transfer body and configured to apply a voltage to said inside surface to thereby invert the polarity of the toner left on said intermediate image transfer body after the secondary image transfer and then cause said toner to again deposit on said image carrier at a primary image transfer position;

wherein a voltage of a same polarity as the toner is applied to said second electrode member.

16. The apparatus as claimed in claim 15, wherein the voltage applied to the inside surface of said intermediate image transfer body is subject to constant current control.

17. The apparatus as claimed in claim 15, wherein the voltage applied to said second electrode member is identical in polarity and size as the voltage applied to said intermediate image transfer body.

18. An image forming apparatus comprising:

an image carrier to which a toner image of preselected polarity is transferred;

an intermediate image transfer body to which the toner image is transferred from said image carrier by primary image transfer;

a first electrode member electrically connected to an inside surface of said intermediate image transfer body and configured to apply a voltage of same polarity as regular polarity of toner to said inside surface to thereby transfer the toner image from said intermediate image transfer body to a recording medium by secondary image transfer; and a second electrode member supported by a frame of said image forming apparatus in the vicinity of at least one of upstream and downstream of said first electrode member;

wherein a portion of said second electrode member contacting said intermediate image transfer body and the frame are insulated from each other.

19. The apparatus as claimed in claim 18, wherein the voltage applied to said second electrode member is identical in polarity and size as the voltage applied to said intermediate image transfer body.

* * * * *